US008662914B2

(12) United States Patent
Keswani

(10) Patent No.: US 8,662,914 B2
(45) Date of Patent: Mar. 4, 2014

(54) ELECTRICAL CONNECTOR SYSTEM AND METHOD FOR MAKING THE SAME

(75) Inventor: Sushil N. Keswani, Sycamore, IL (US)

(73) Assignee: Ideal Industries, Inc., Sycamore, IL (US)

( * ) Notice: Subject to any disclaimer, the term of this patent is extended or adjusted under 35 U.S.C. 154(b) by 0 days.

(21) Appl. No.: 13/252,399

(22) Filed: Oct. 4, 2011

(65) Prior Publication Data

US 2013/0084757 A1 Apr. 4, 2013

(51) Int. Cl.
*H01R 4/24* (2006.01)

(52) U.S. Cl.
USPC ..... 439/441; 439/787

(58) Field of Classification Search
USPC ..... 439/441, 727, 834, 787
See application file for complete search history.

(56) References Cited

U.S. PATENT DOCUMENTS

| | | | | |
|---|---|---|---|---|
| 4,973,266 | A | 11/1990 | Bullard | |
| 5,066,242 | A | 11/1991 | Martucci | |
| 5,423,692 | A | 6/1995 | Francis | |
| 6,033,261 | A | 3/2000 | Wakata et al. | |
| 6,190,203 | B1 | 2/2001 | Murakami et al. | |
| 7,114,986 | B1 * | 10/2006 | Toly | 439/441 |
| 7,727,002 | B2 * | 6/2010 | Bethurum et al. | 439/441 |
| 7,771,217 | B2 * | 8/2010 | Bethurum et al. | 439/153 |
| D626,068 | S | 10/2010 | Giefers et al. | |
| 2011/0076900 | A1 | 3/2011 | Keswani et al. | |
| 2011/0111612 | A1 | 5/2011 | Su et al. | |
| 2011/0294321 | A1 | 12/2011 | Sagdic et al. | |
| 2011/0318975 | A1 | 12/2011 | Giefers et al. | |

OTHER PUBLICATIONS

ISA/US, International Search Report and Written Opinion of PCT Application No. US12/57051, 11 pages.

* cited by examiner

*Primary Examiner* — Briggitte R Hammond
(74) *Attorney, Agent, or Firm* — Greenberg Traurig, LLP

(57) ABSTRACT

An electrical connector system and method for making same, for joining adjacent ends of electrical power conductors, including a female connector assembly and a male connector assembly. Each of the female and male connector assemblies is provided with push-in type, spring mechanism to facilitate the insertion of a bared end of an electrical conductor, into the respective female or male connector housing for secured engagement of the bared end of the electrical conductor, without the assembler having to make physical contact with any electrically conductive structures.

12 Claims, 9 Drawing Sheets

ELECTRICAL CONNECTOR SYSTEM AND METHOD FOR MAKING THE SAME

BACKGROUND

In the art, devices for providing connections between conductors (e.g., wires or cables) for electrical current are known. Electrical connector devices intended for use in the environment of electrical power transmission systems for conveying electricity from photovoltaic cells are known.

Published US patent application US 2011/0111612 A1 describes and illustrates an electrical connector structure for multi-strand conductors, in which a post-shaped contact is crimped onto the end of one conductor to form the male connector, and a cylindrically-shaped contact is crimped onto the end of another conductor to form the female connector. The post-shaped contact of the male connector is surrounded by a cylindrical shroud which is configured to surround and cover the female connector, when the male and female connectors are engaged. Sealing washers are employed towards creating a moisture-resistant seal where the post- and cylindrically-shaped contacts meet.

International application publication no. WO 2010/089023 A1 describes and illustrates electrical plug connectors which employ releasable clip and releasing tab structures, for holding the male and female connectors together.

US D626,068 illustrates and claims the ornamental appearance of an electrical connector with a locking and release device.

International application publication no. WO 2010/066399 A1 describes and illustrates an electrical connector, in which the end of the conductor is captured within a clamp structure, which forms part of an electrical contact, which is, in turn surrounded by a shell to form a connector structure.

While the devices described in these publications, which are incorporated herein by reference in their entirety, generally work for their intended purpose, the following describes an improved electrical connector system, and method for making same.

SUMMARY

Described hereinafter is an improved mating pair of male and female electrical connectors, which are particularly suited for use in field installations for power current carrying applications, such as the conductors used to convey electrical power from photovoltaic panels.

More particularly, and by way of non-limiting example, the subject electrical connector system includes female and male electrical connectors, each configured to receive an end of an electrical conductor, in the field if so required, in such a manner that the installer does not have to handle or make direct contact with any electrically conductive members in order to permanently affix the female and male electrical connectors to their respective electrical conductors. Each of the female and male connectors includes a connector housing, and positioned within the housing, a connector member configured to make complementary electrically conductive contact with the connector member for the other connector component of the system, and a push-in, spring type connector configured to insertably receive and non-releasably grip the bared end of a conductor.

Releasable barbed prongs and complementary barb engaging slots are provided on the female and male connector housings, respectively, to enable the female and male connectors to be releasably connected to one another. In an alternative embodiment of the invention, the relative positions may be swapped, so that the barbed prongs emanate from the male connector member and the complementary barb engaging slots may be provided on the female connector housing.

While the foregoing provides a general description of the subject device and system, a better understanding of the objects, advantages, features, properties and relationships of the subject device and system will be obtained from the following detailed description and accompanying drawings which set forth illustrative embodiments and which are indicative of the various ways in which the principles of the invention may be employed.

BRIEF DESCRIPTION OF THE DRAWINGS

For a better understanding of the hereinafter described connector system, reference may be had to the following drawings in which.

DETAILED DESCRIPTION

Figure 1:
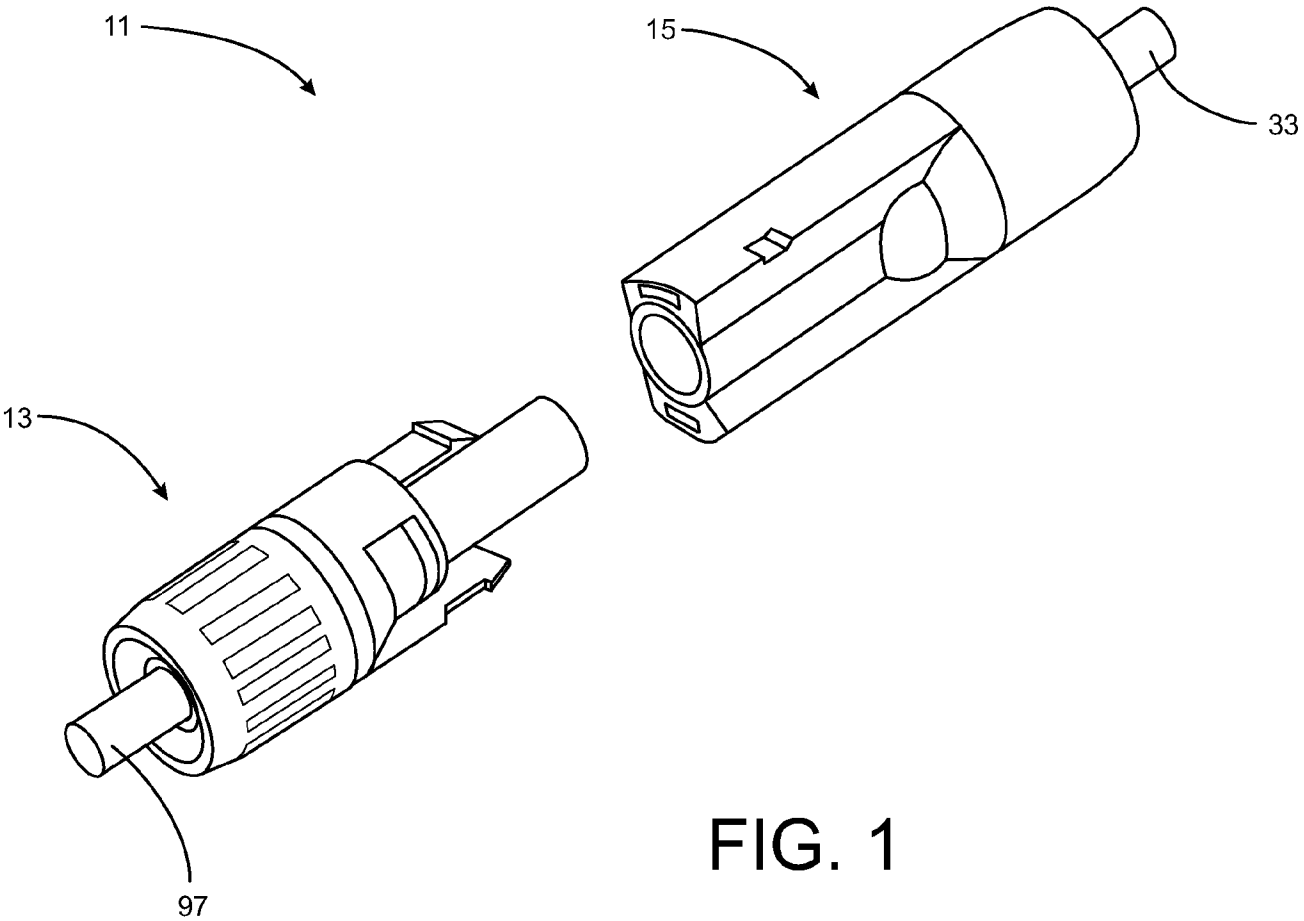
FIG. 1 is a perspective view of the female connector and the male connector for the electrical connector system of the present invention.

With reference to the figures, the following describes an electrical connector system 11. As particularly shown in FIG. 1, the electrical connector system 11 is comprised of a female connector 13 which is adapted to be releasably mated with a male connector 15.

Figure 2:
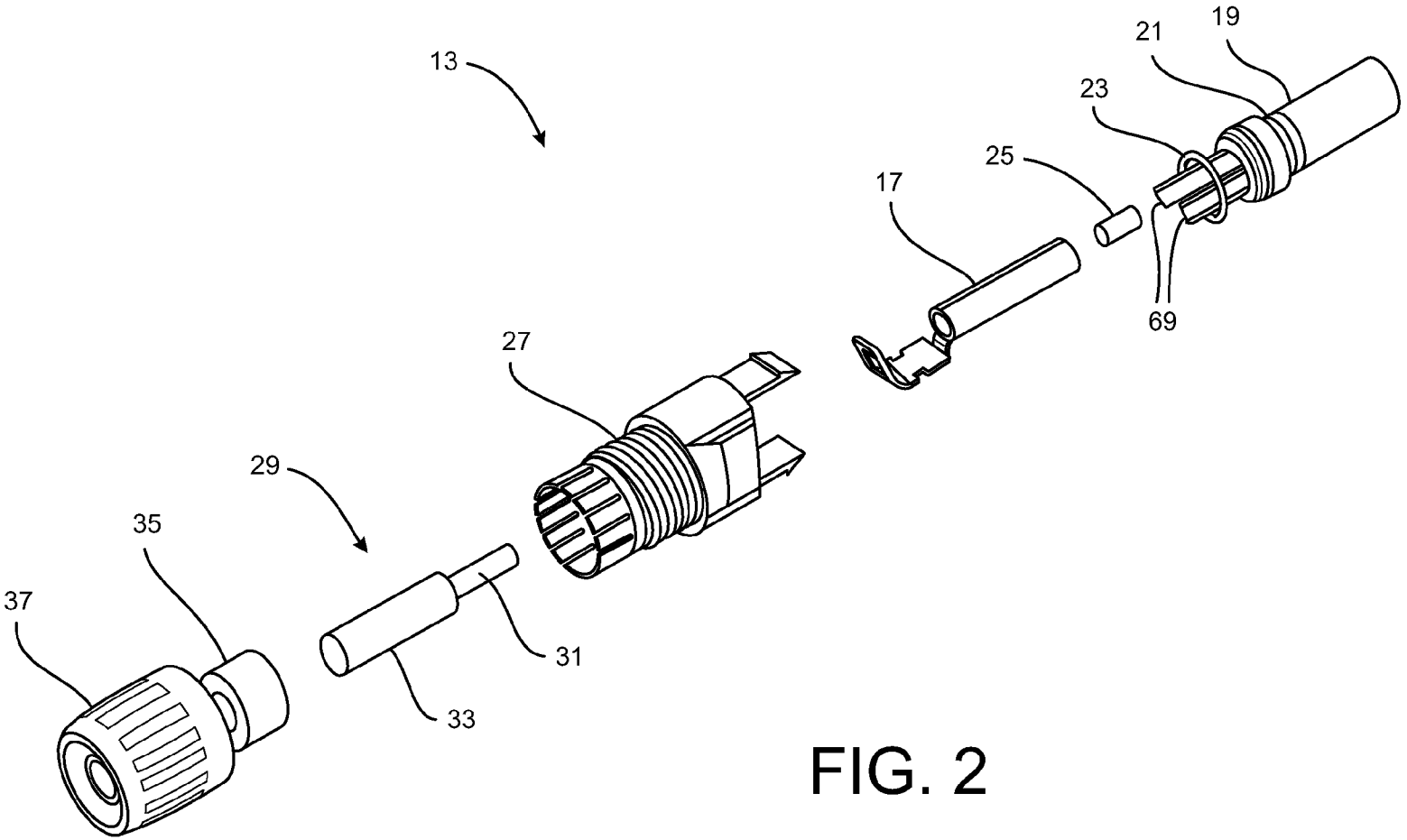
FIG. 2 is a perspective exploded view of the female connector of the embodiment shown in FIG. 1.
Figure 3:
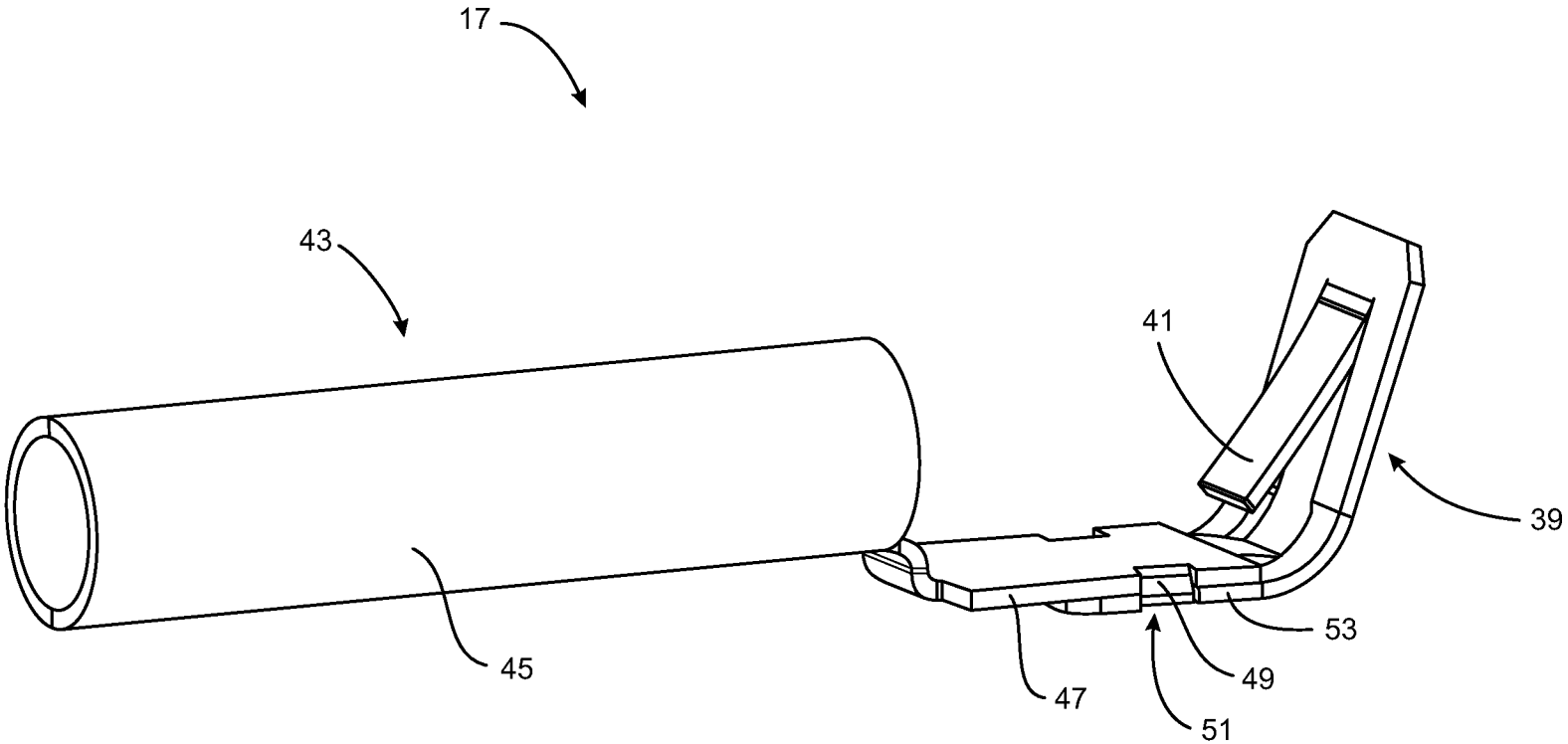
FIG. 3 is a perspective view of the electrical contact and spring assembly for the female connector of the embodiment shown in FIGS. 1 and 2.
Figure 4:
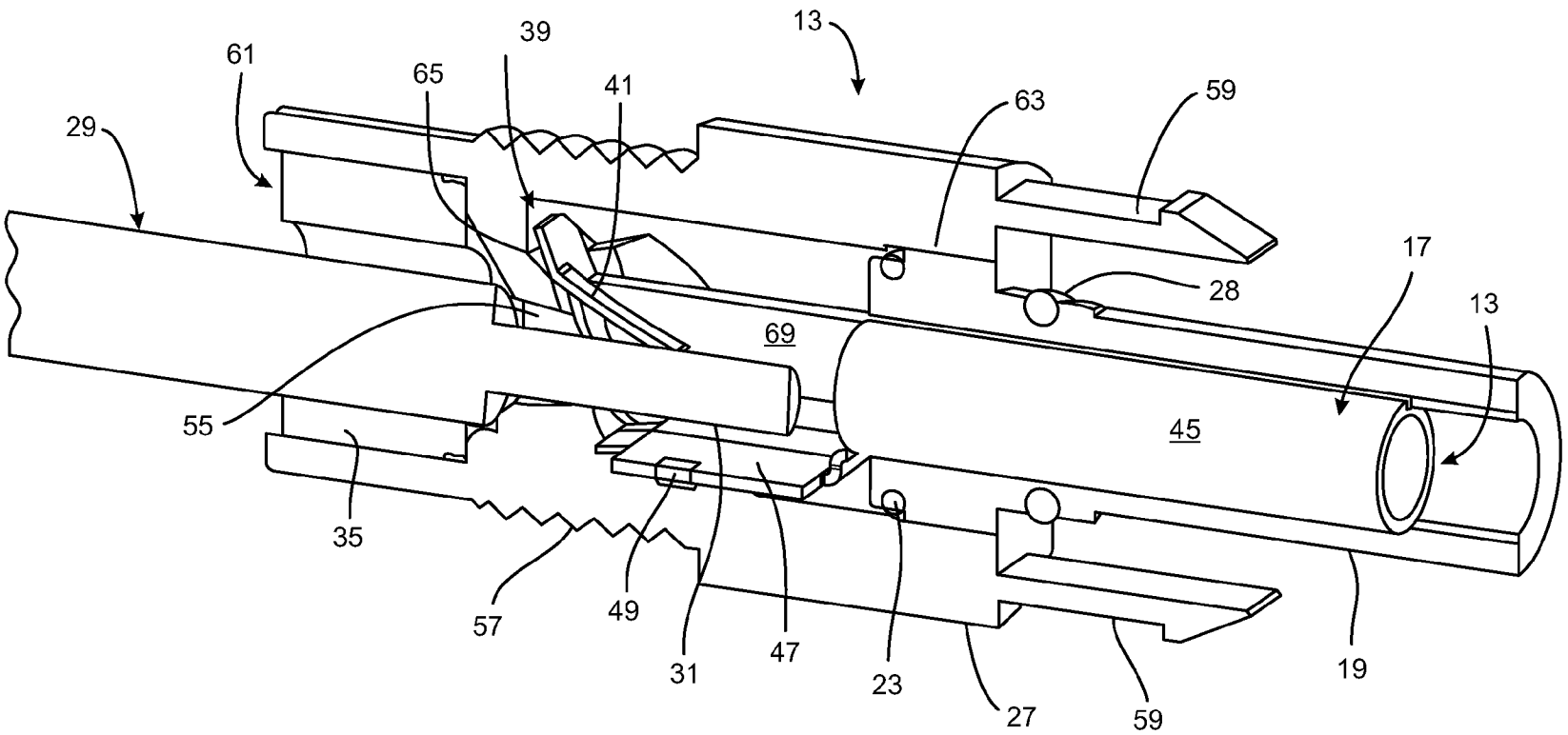
FIG. 4 is a perspective view, in section, of a completed female connector of the embodiment shown in FIGS. 1 and 2;.

Female connector 13 is shown in greater detail in FIGS. 2-4. The components of female connector 13 are shown in exploded view, in FIG. 2, wherein female connector 13 includes: female connector and spring assembly 17; female connector cap 19; connection seal O-ring 21, housing seal O-ring 23; cylinder spring 25 (optional); female connector housing 27; conductor end 29 (which is to be inserted into female connector 13), including bared end 31 and insulation 33; gasket seal 35; and locking nut 37 (which has internal screw threads—not shown). Bared end 31 may be composed of a collection of individual wire strands, or, given that conductor end 29 is configured for transmission of power, not data, bared end may be a single wide strand (so as to reduce electrical resistance).

Female connector and spring assembly 17 is shown in greater detail in FIG. 3. Female spring member 39 includes tang 41 (which itself defines an aperture within female spring member 39), which serves to grip bared end 31 of conductor end 29, in a manner described in further detail hereinafter. Female connector member 43 includes cylindrical portion 45 and tab 47, which, in an embodiment of the invention, grips and is affixed to female spring member 39 by bent prong(s) 49 extending from tab 47 of female connector member 42, which prong(s) 49 may engage notch(es) 51 formed in tab 53. The components of female connector and spring assembly 17 may be fabricated from any suitable electrically conductive material, which also has the necessary strength, toughness and ductility characteristics to be able to hold together, and (in the case of spring member 39) firmly and lockingly engage conductor end 29, as described herein.

FIG. 4 shows a completed female connector 13, wherein female connector and spring assembly 17 is positioned within female connector housing 27. Female connector housing 27 includes off-center bore 55 (through which bared end 31 of conductor end 29 is intended to pass), screw threads 57, and barbed prongs 59. Female connector and spring assembly 17 is inserted into the proximal opening 63 of female connector housing 27 until female spring member 39 abuts wall 65. Female connector cap 19 (bearing housing seal O-ring 23) is pressed into proximal opening 63 of the female connector housing 27 and is oriented so that tabs 69 (one of which is shown in FIG. 4) will extend to either side of spring member 39. A groove 28 is provided on the outer surface of female connector cap 19 to provide a seat to facilitate stabilization of connection seal O-ring 21. Grooves (not shown) may be provided on the inner surface of female connector housing 27, to receive tabs 69, so that female connector cap 19 can be rotationally fixed, relative to female connector housing 27. In this regard, female connector cap 19 and female connector housing 27 are preferably arranged to allow female connector cap 19 to be snap fit into engagement with female connector housing 27. Female connector housing 27 and end cap 19 may be fabricated from any suitable electrically non-conductive material.

To assemble female connector 13 with the conductor 29, and referring to FIG. 4, first, locking nut 37 and gasket seal 35 (FIG. 2) are slid onto conductor end 29. Insulation 33 is then (or will have been) stripped away from conductor end 29 for a short distance from the extreme tip thereof, to create bared end 31. Conductor end 29 is then pushed into distal opening 61 of completed female connector housing 27, and bared end 31 passes through bore 55. Bared end 31 passes through female spring member 39, and deflects tang 41 upwardly and toward proximal opening 63. Once the pushing effort on conductor end 29 has stopped, the extreme end 67 of tang 41 (fabricated from a suitably stiff material and which may have a slight edge imparted thereto) will tend to "dig" into the outer surface of bared end 31. This will help to prevent separation of conductor end 29 from female connector 13. Gasket seal 35 may then be slid up conductor end 29 and into distal opening 61. Locking nut 37 is then pushed up and onto the end of female connector housing 27, and screwed onto screw threads 57 Annular gasket seal 35 and locking nut 37 help prevent the intrusion of water and contaminants like dirt into female connector housing 27.

Figure 5:
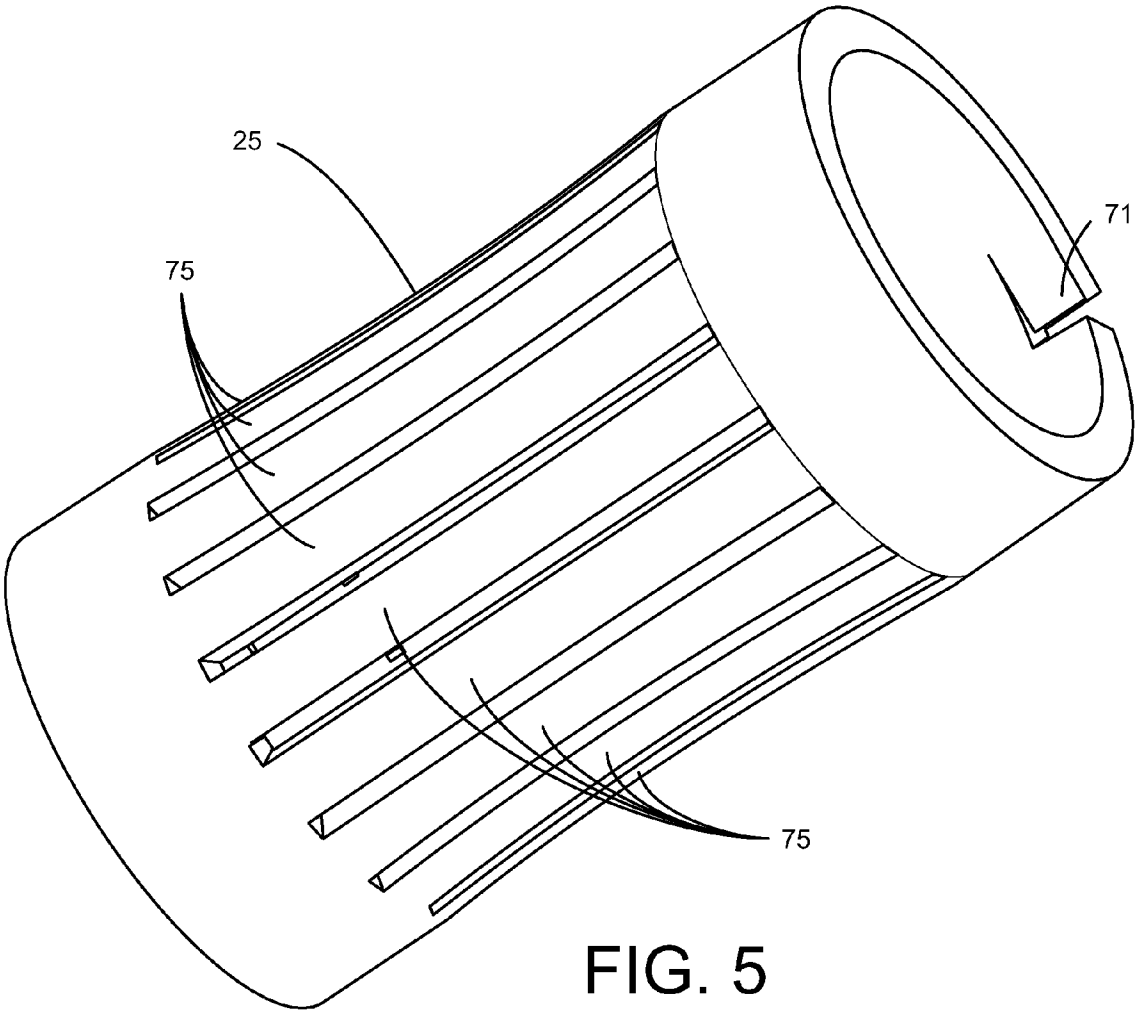
FIG. 5 is a perspective view of a cylindrical spring, which may be used in preferred embodiments of the present invention.

Female connector 13 may include cylinder spring 25 (FIG. 5), which may be inserted into the bore 73 (FIG. 6) of cylindrical portion 45 of female connector member 43. Cylinder spring 25 may be provided with outwardly projecting tang 71, which can engage with the inner surface of cylindrical portion 45, to retain cylinder spring 25 within cylindrical portion 45. Cylinder spring 25 may also be provided with inwardly bowing splines 75, distributed around the circumference of cylinder spring 25. The function of splines 75 will be described in further detail hereinafter.

Figure 6:
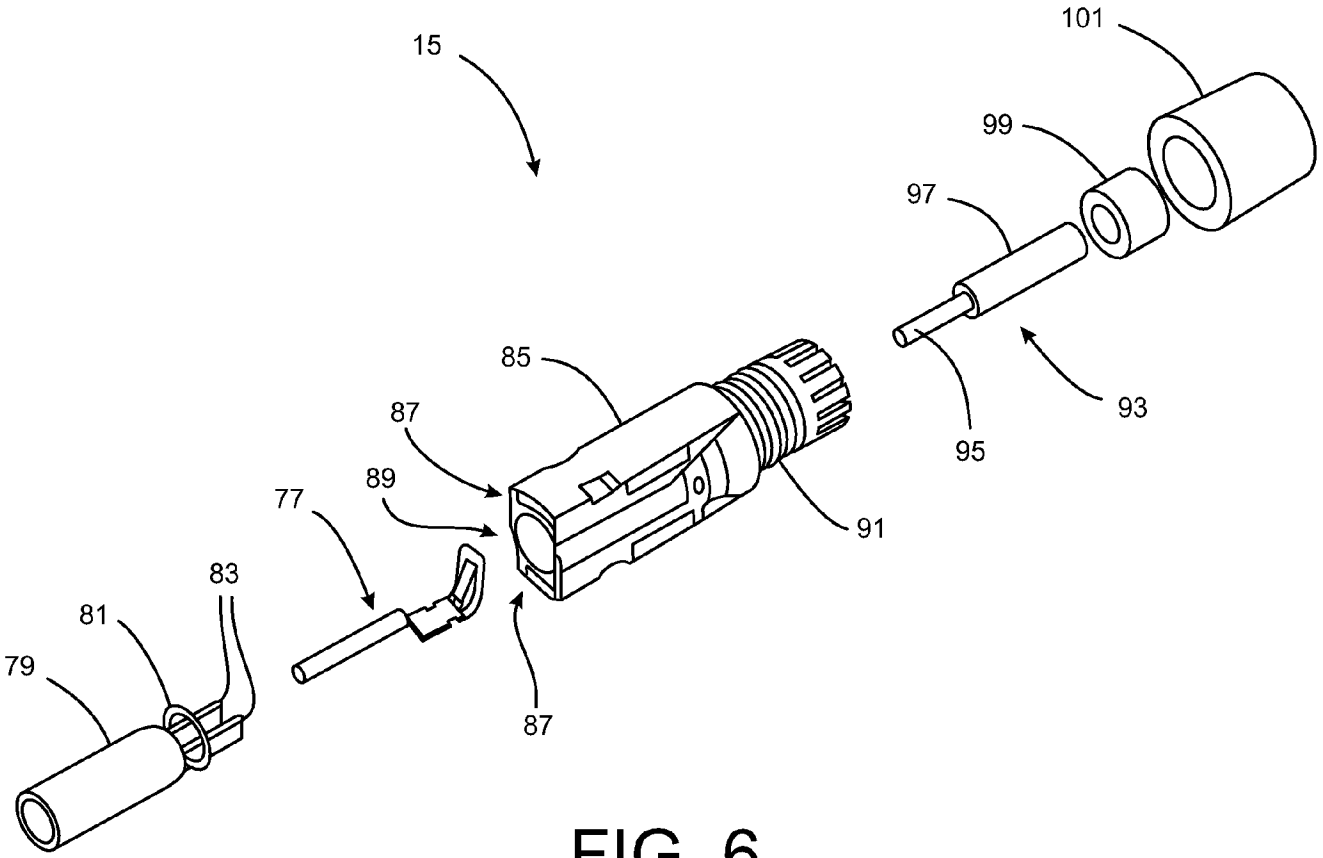
FIG. 6 is an exploded perspective view of the male connector of the embodiment shown in FIG. 1.
Figure 7:
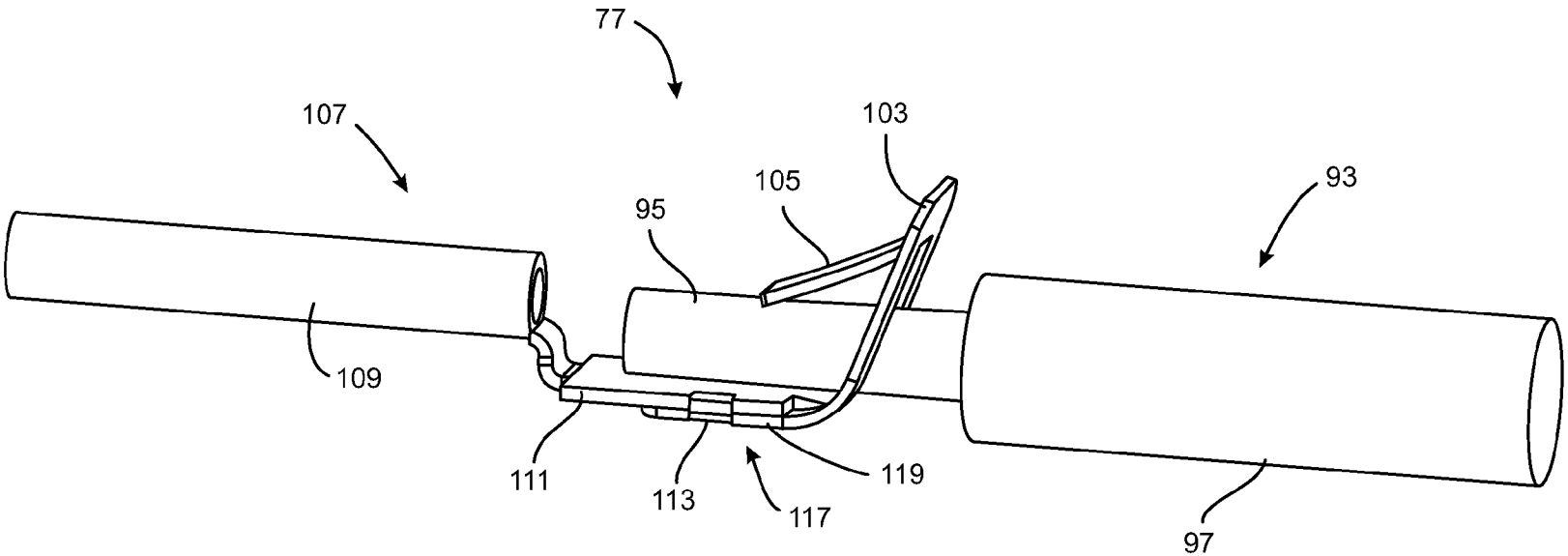
FIG. 7 is a perspective view of the electrical contact and spring assembly for the male connector of the embodiment shown in FIGS. 1 and 6.
Figure 8:
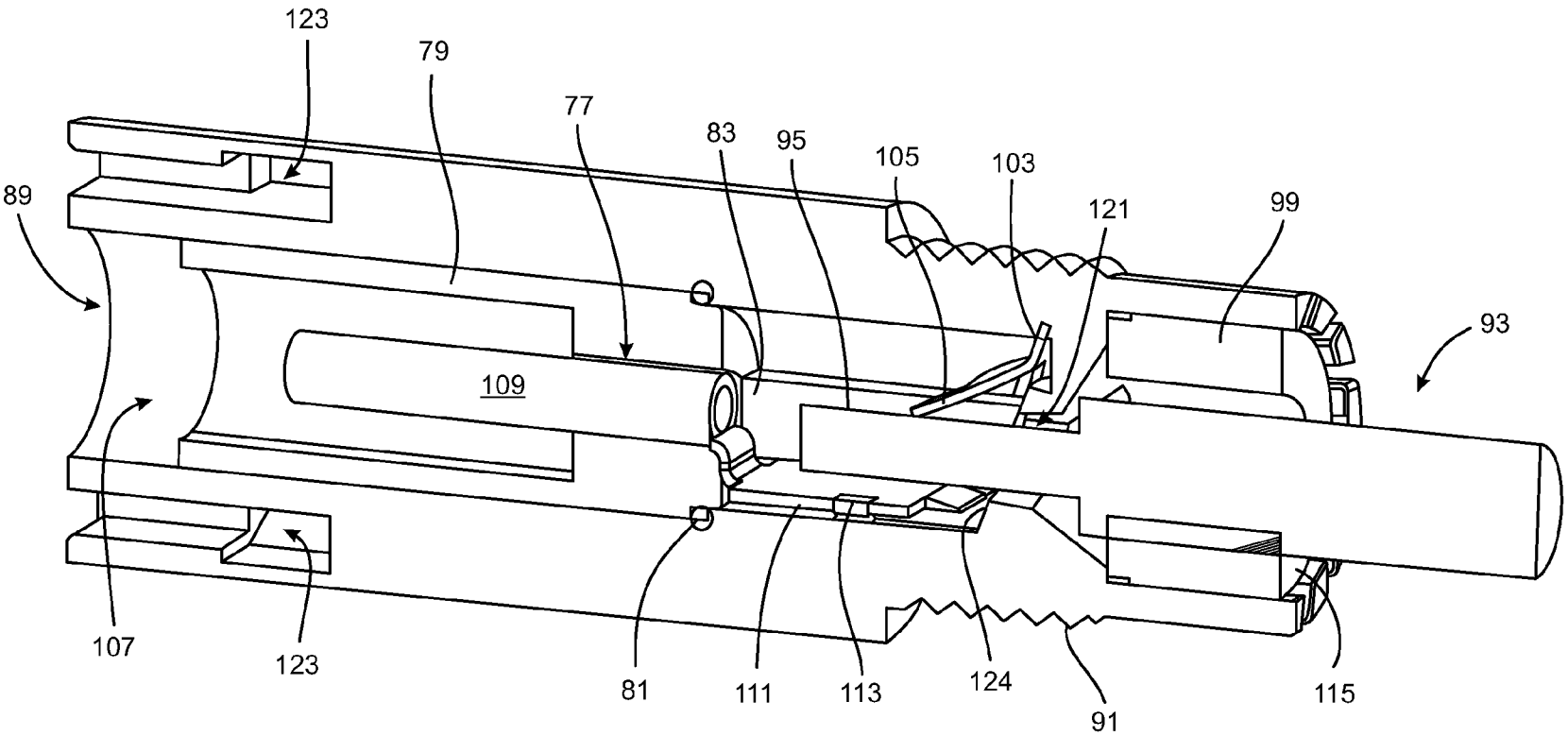
FIG. 8 is a perspective view, in section, of a completed male connector of the embodiment shown in FIGS. 1 and 6.

FIGS. 6-8 illustrate the components and assembly of male connector 15. As shown in the exploded view of FIG. 6, male connector 15 includes male connector and spring assembly 77; male connector cap 79 with housing seal O-ring 81 and tabs 83; male connector housing 85 having slots 87, proximal opening 89 and screw threads 91; conductor end 93 (which is to be inserted into male connector 15), including bared end 95 and insulation 97; gasket seal 99 and locking nut 101.

Male connector and spring assembly 77 is shown in greater detail in FIG. 7. Male spring member 103 includes tang 105 (which itself defines an aperture within male spring member 103), which serves to grip bared end 95 of conductor end 93, in a manner described in further detail hereinafter. Male connector member 107 includes cylindrical portion 109 and tab 111, which, in an embodiment of the invention, grips and is affixed to male spring member 103 by bent prong(s) 113 extending from tab 111, which may engage notch(es) 117 formed in tab 119. The components of male connector and spring assembly 77 may be fabricated from any suitable electrically conductive material, which also has the necessary strength, toughness and ductility characteristics to be able to hold together, and (in the case of male spring member 103) firmly and lockingly engage conductor end 93, as described herein.

FIG. 8 shows a completed male connector 15 wherein male connector and spring assembly 77 is inserted into proximal opening 89 of male connector housing 85, until male spring member 103 abuts wall 124. Male connector cap 79 (bearing housing seal O-ring 81) is pressed into proximal opening 85, oriented so that tabs 83 (one of which is shown in FIG. 8) extend to either side of male spring member 103. Grooves (not shown) may be provided on the inner surface of male connector housing 85, to receive tabs 83, so that male connector cap 79 can be rotationally fixed, relative to male connector housing 85. In this regard, male connector cap 79 and male connector housing 85 are preferably arranged to allow male connector cap 79 to be placed into snap fit engagement male connector housing 85. Male connector housing 85 and end cap 79 may be fabricated from any suitable electrically non-conductive material.

To assemble male connector 15 with the conductor 93, first locking nut 101 and gasket seal 99 are slid onto conductor end 93. A portion of insulation 97 is then stripped away (or has been stripped away) to create bared end 95. Conductor end 93 is inserted into distal opening 115, until bared end 95 passes through bore 121, through male spring member 103, where the bared end 95 deflects and is engaged by tang 105, in the same manner or substantially the same manner that bared end 31 of conductor end 29 is engaged by tang 41 of female spring member 39 in female connector 13. Gasket seal 99 is then slid up conductor end 93 and pushed into distal opening 115. Once conductor end 93 has been engaged by male connector and spring assembly 77, locking nut 101 (FIG. 6) can then be screwed onto screw threads 91 to complete assembly of male connector 15 onto conductor end 93. Annular gasket seal 99 and locking nut 101 help prevent the intrusion of water and contaminants like dirt into male connector housing 85.

Figure 9:
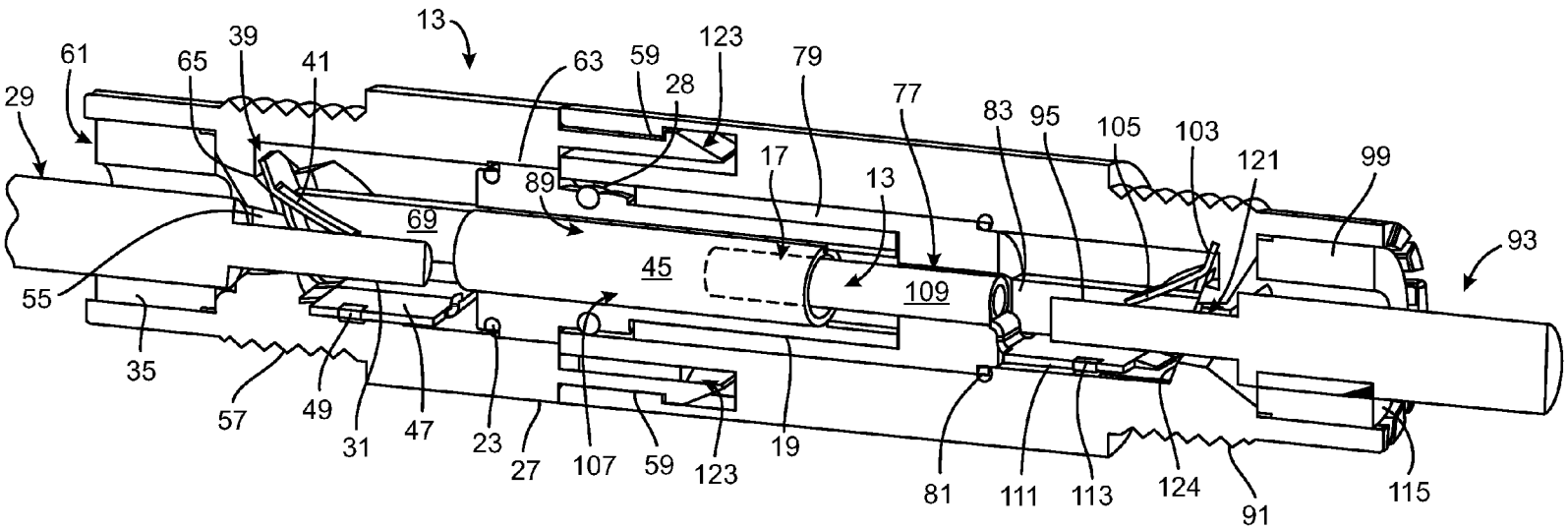
FIG. 9 is a perspective view, in section, of the male connector coupled to the female connector.

As illustrated in FIG. 9, to releasably connect female connector 13 to male connector 15, the two components are brought together. Barbed prongs 59 will be inserted into slots 87, while simultaneously, female connector cap 19 is inserted into proximal opening 89 of male connector housing 85. The outer diameter of cylindrical portion 109 of male connector 107 will have a diameter which is configured to have a sliding frictional fit into cylindrical portion 45 of female connector member 43, wherein the actual electrically conductive contact is made. However, because a good electrical contact requires a good solid connection, cylinder spring 25 may be inserted into cylindrical portion 45. Splines 75, which bow inwardly, can have a minimum inner diameter which is actually less than the outer diameter of cylindrical portion 109, but, because splines 75 will have a spring-like resiliency, they will be able to be pushed radially outwardly, to accommodate cylindrical portion 109 of male connector 107, and yet make solid electrically conductive contact with cylindrical portion 109. Once female connector 13 and male connector 15 are fully engaged, the barbs on barbed prongs 59 will releasably engage with complementary barb engaging structures 123 provided in slots 87.

The foregoing description and drawings merely explain and illustrate the invention, and the invention is not limited thereto, except as those skilled in the art who have the present disclosure before them will be able to make modifications and variations therein without departing from the scope of the invention.

What is claimed is:

1. An electrical connector system comprising:

a female connector comprised of a non-electrically-conductive female connector housing carrying a first electrically-conductive push-in type connector and spring assembly configured to receive and grip a bared end of a first electrical conductor; and a male connector comprised of a non-electrically-conductive male connector housing carrying a second electrically-conductive push-in type connector and spring assembly configured to receive and grip a bared end of a second electrical conductor;

wherein the female and male connector housings are operably configured to be releasably connected and, when connected, to bring the electrically conductive first and second push-in type connector and spring assemblies into electrically conductive contact with one another, wherein one of the first and second push-in type connector and spring assemblies is a female push-in type connector comprising a female connector member which is formed as a hollow cylindrical member having a first inner diameter and the other of the first and second push-in type connector and spring assemblies is a male push-in type connector comprising a male connector member which is formed as a cylindrical member having a first outer diameter which is less than the first inner diameter of the female connector member whereby electrical connectivity between the female and male push-in type connector and spring assemblies is achieved by positioning the male connector member of the male push-in type connector and spring assembly in the female connector member of the female push-in type connector and spring assembly.

2. The electrical connector system according to claim 1, wherein the male push-in type connector and spring assembly includes an aperture and a biased tang member and the male push-in type connector and spring assembly is operably positioned within one of the male or female connector housing such that upon insertion of a bared end of the second electrical conductor the bared end deflects the biased tang member to enable the bared end to be insertably received through the aperture with the biased tang thereupon resistively engaging the bared end to preclude withdrawal of the bared end of the second electrical conductor from the connector housing.

3. The electrical connector system according to claim 1, wherein the female push-in type connector and spring assembly includes an aperture and a biased tang member and the female push-in type connector and spring assembly is operably positioned within one of the male or female connector housing such that upon insertion of the bared end of the first electrical conductor the bared end deflects the biased tang member to enable the bared end to be insertably received through the aperture with the biased tang thereupon resistively engaging the bared end to preclude withdrawal of the bared end of the first electrical conductor from the connector housing.

4. The electrical connector system according to claim 1, wherein the female and male housing members have complimentary, releasable, locking members.

5. The electrical connector system according to claim 4, wherein the complimentary, releasable, locking members comprise one of the female and male connector housings having a resilient, barbed prong and the other of the female and male connector housings having an engaging slot for releasably engaging the barbed prong.

6. The electrical connector system according to claim 1, comprising a hollow cylindrical female connector cap, emanating from the female connector housing;

a hollow cylindrical male connector cap, emanating from the male connector housing, and insertably receivable within the female connector cap;

the female and male connector caps being cooperatively configured to facilitate alignment of the female and male connectors with each other during attachment of same to establish an electrically conductive connection therebetween.

7. The electrical connector assembly as recited in claim 6, comprising:

an o-ring disposed between at least one of the female connector cap and the female connector housing and the male connector cap and the male connector housing.

8. The electrical connector assembly as recited in claim 1, comprising:

a nut having an opening attachable to the female connector housing wherein the first electrical conductor is fed to the first push-in type connector and spring assembly via the opening.

9. The electrical connector assembly as recited in claim 8, comprising:

a gasket seal disposed within the nut.

10. The electrical connector assembly as recited in claim 1, comprising:

a nut having an opening attachable to the male connector housing wherein the second electrical conductor is fed to the second push-in type connector and spring assembly via the opening.

11. The electrical connector assembly as recited in claim 10, comprising:

a gasket seal disposed within the nut.

12. An electrical connector system comprising:

a female connector comprised of a non-electrically-conductive female connector housing carrying a first electrically-conductive push-in type connector and spring assembly configured to receive and grip a bared end of a first electrical conductor; and a male connector comprised of a non-electrically-conductive male connector housing carrying a second electrically-conductive push-in type connector and spring assembly configured to receive and grip a bared end of a second electrical conductor;

wherein the female and male connector housings are operably configured to be releasably connected and, when connected, to bring the electrically conductive first and second push-in type connector and spring assemblies into electrically conductive contact with one another, and a cylinder spring member, disposed within one of the female or male connector housing and positioned in electrically conductive contact with the female push-in type connector and spring assembly, having a resiliently variable inner diameter for receiving a male connector member having an outer diameter which is sufficient to ensure electrically conductive contact with an inner surface of the connector of the female push-in type connector and spring assembly.

* * * * *